US008240065B2

(12) United States Patent
Rampersad et al.

(10) Patent No.: US 8,240,065 B2
(45) **Date of Patent: *Aug. 14, 2012**

(54) FREEZE-DRYER AND METHOD OF CONTROLLING THE SAME

(75) Inventors: Bryce Mark Rampersad, Bloomingdale, IL (US); Robert Rex Sever, Arlington Heights, IL (US); Balazs Hunek, Chicago, IL (US); Theodore Hall Gasteyer, III, Naperville, IL (US)

(73) Assignee: Praxair Technology, Inc., Danbury, CT (US)

( * ) Notice: Subject to any disclaimer, the term of this patent is extended or adjusted under 35 U.S.C. 154(b) by 609 days.

This patent is subject to a terminal disclaimer.

(21) Appl. No.: 12/414,760

(22) Filed: Mar. 31, 2009

(65) Prior Publication Data

US 2010/0242301 A1 Sep. 30, 2010

Related U.S. Application Data

(63) Continuation-in-part of application No. 11/702,472, filed on Feb. 5, 2007, and a continuation-in-part of application No. 11/702,479, filed on Feb. 5, 2007.

(51) Int. Cl.
*F26B 21/10* (2006.01)
*F26B 5/06* (2006.01)

(52) U.S. Cl. ..... 34/558; 34/559; 34/92; 34/284

(58) Field of Classification Search ..... 34/284, 34/285, 402, 403, 405, 524, 527, 558, 559, 34/82, 92

See application file for complete search history.

(56) References Cited

U.S. PATENT DOCUMENTS

| | | | | |
|---|---|---|---|---|
| 4,401,444 | A | 8/1983 | Teller | |
| 4,504,285 | A | 3/1985 | Modisette | |
| 4,590,684 | A | 5/1986 | Arsem | |
| 4,597,188 | A | 7/1986 | Trappler | |
| 4,842,812 | A * | 6/1989 | Panson et al. | 376/306 |

(Continued)

FOREIGN PATENT DOCUMENTS

GB 2400901 A 10/2004

(Continued)

OTHER PUBLICATIONS

Vonnegut, B., "The Nucleation of Ice Formation by Silver Iodide", Journal of Applied Physics, 1947, pp. 593-595, vol. 18, No. 7.

(Continued)

*Primary Examiner* — Jiping Lu
(74) *Attorney, Agent, or Firm* — Robert J. Hampsch

(57) ABSTRACT

A freeze-dryer and method of controlling the same is provided. The disclosed freeze-dryer includes a chamber adapted to hold material or product to be freeze-dried; one or more depressurization orifices; a gas pressurization circuit having a source of gas to pressurize the chamber to a prescribed pressure; a depressurization circuit coupled to the chamber via the one or more orifices and having a depressurizing control valve; and a control unit adapted to pressurize the chamber with the source of gas and actuate the depressurizing control valve to depressurize the chamber upon command. The ratio of total depressurization orifice area to the chamber volume is preferably between about $6\times10^{-2}$ and about $4\times10^{-4}$ $m^2/m^3$.

8 Claims, 8 Drawing Sheets

U.S. PATENT DOCUMENTS

| | | | | |
|---|---|---|---|---|
| 5,966,966 | A | 10/1999 | Botsaris et al. | |
| 6,447,701 | B1 | 9/2002 | Heschel et al. | |
| 6,558,434 | B1 | 5/2003 | Furrer et al. | |
| 6,684,524 | B1 | 2/2004 | Sennhenn et al. | |
| 7,108,832 | B2 * | 9/2006 | Christensen et al. | 422/28 |
| 2002/0031577 | A1 | 3/2002 | Arends et al. | |
| 2004/0107901 | A1 * | 6/2004 | Del Re et al. | 118/313 |
| 2005/0281737 | A1 | 12/2005 | Kuperus et al. | |
| 2007/0186437 | A1 | 8/2007 | Gasteyer et al. | |

FOREIGN PATENT DOCUMENTS

| | | | |
|---|---|---|---|
| WO | WO 95/22036 | | 8/1995 |
| WO | WO 01/09559 | A1 | 2/2001 |

OTHER PUBLICATIONS

Margaritis et al., "Principles and Biotechnological Applications of Bacterial Ice Nucleation", 1991, pp. 277-295, 11(3).

Searles et al., "The Ice Nucleation Temperature Determines the Primary Drying Rate of Lyophilization for Samples Frozen on a Temperature-Controlled Shelf", Journal of Pharmaceutical Sciences, 2001, pp. 860-871, vol. 90, No. 7.

Rambhatla et al., "Heat and Mass Transfer Scale-up Issues During Freeze Drying: II.Control and Characterization of the Degree of Supercooling", AAPS PharmSciTech, 2004, pp. 1-9, 5 (4) Article 58.

* cited by examiner

FREEZE-DRYER AND METHOD OF CONTROLLING THE SAME

CROSS REFERENCE TO RELATED APPLICATIONS

This application is a continuation-in-part of U.S. patent application Ser. No. 11/702,472 filed Feb. 5, 2007 and U.S. patent application Ser. No. 11/702,479 filed Feb. 5, 2007.

FIELD OF THE INVENTION

The present invention relates to a freeze-dryer and method of controlling the same, and more particularly, to a freeze-dryer that is controllably pressurized and subsequently depressurized so as to induce nucleation of freezing in the material undergoing lyophilization in the freeze-dryer.

BACKGROUND OF THE INVENTION

In a typical pharmaceutical freeze-drying process, multiple vials containing a liquid drug formulation are loaded on temperature-controlled shelves within a sterile chamber and cooled to low temperatures until completely solidified. Following this freezing step, the freeze-drying chamber pressure is reduced and the shelf temperature adjusted to enable removal of the frozen solvent (i.e., drying) via sublimation in a step termed "primary drying." When sublimation is complete, the shelf temperature is raised during "secondary drying" to remove additional un-frozen solvent bound to the solid product by e.g. adsorption. When sufficient solvent is removed, the drying process is concluded by stoppering the vials or bottles in the chamber, generally under a sub-ambient pressure of inert gas. The final dry product is called a "cake" and usually occupies the same approximate volume as the initial liquid fill due to its high porosity. The whole process usually takes multiple days to complete.

Controlling the generally random process of nucleation in the freezing stage of a lyophilization or freeze-drying process to both decrease processing time necessary to complete freeze-drying and to increase the product uniformity from vial-to-vial in the finished product would be highly desirable in the art. During the freezing step, the aqueous solution in each vial is cooled below the thermodynamic freezing temperature of the solution and remains in a sub-cooled metastable liquid state until nucleation occurs. The range of nucleation temperatures across the vials is distributed randomly between a temperature near the thermodynamic freezing temperature and some value significantly (e.g., as much as 30° C.) lower than the thermodynamic freezing temperature. This distribution of nucleation temperatures causes vial-to-vial variation in ice crystal structure and ultimately the physical, chemical, or biological properties of the lyophilized product. Furthermore, the drying stage of the freeze-drying process must be excessively long to accommodate the range of ice crystal sizes and structures produced by the natural stochastic (i.e., random or uncontrolled) nucleation phenomenon.

Additives have been used to increase the nucleation temperature of sub-cooled solutions. These additives can take many forms. It is well known that certain bacteria (e.g., *Pseudomonas syringae*) synthesize proteins that help nucleate ice formation in sub-cooled aqueous solutions. Either the bacteria or their isolated proteins can be added to solutions to increase the nucleation temperature. Several inorganic additives also demonstrate a nucleating effect; the most common such additive is silver iodide, AgI. In general, any additive or contaminant has the potential to serve as a nucleating agent.

Lyophilization vials prepared in environments containing high particulate levels will generally nucleate and freeze at a lower degree of sub-cooling than vials prepared in low particulate environments.

All the nucleating agents described above are labeled "additives," because they change the composition of the medium in which they nucleate a phase transition. These additives are not typically acceptable or desirable for FDA regulated and approved freeze-dried pharmaceutical products. These additives also do not provide control over the time and temperature when the vials nucleate and freeze. Rather, the additives only operate to increase the average nucleation temperature of the vials.

Equipment driven means to induce nucleation have also been attempted. Such methods have included: (i) creating ice crystals within the gas phase of the freeze-drying chamber; (ii) ultrasonic nucleation wherein mechanical vibrations or acoustic waves are imparted to the product in the vials on the freeze-dryer shelves; (iii) electro-freezing wherein an electric field is applied across electrodes submersed within the product; and (iv) vacuum induced surface freezing.

Ice crystals created within the gas phase of the freeze-drying chamber can act as nucleating agents for ice formation in sub-cooled aqueous solutions if they are transported into the liquid phase. In this "ice fog" method, a humid freeze-dryer is filled with a cold gas to produce a vapor suspension of small ice particles. The ice particles are transported into the vials and initiate nucleation when they contact the fluid interface. The "ice fog" method does not control the nucleation of multiple vials simultaneously at a controlled time and temperature. In other words, the nucleation event does not occur concurrently or instantaneously within all vials upon introduction of the cold vapor into the freeze-dryer. The ice crystals will take some time to work their way into each of the vials to initiate nucleation, and transport times are likely to be different for vials in different locations within the freeze-dryer. For large scale industrial freeze-dryers, implementation of the "ice fog" method would require system design changes as internal convection devices are required to assist a more uniform distribution of the "ice fog" throughout the freeze-dryer. When the freeze-dryer shelves are continually cooled, the time difference between when the first vial freezes and the last vial freezes will create a temperature difference between the vials, which will increase the vial-to-vial non-uniformity in freeze-dried products.

Vibration has also been used to nucleate a phase transition in a metastable material. Vibration sufficient to induce nucleation occurs at frequencies above 10 kHz and can be produced using a variety of equipment. Often vibrations in this frequency range are termed "ultrasonic," although frequencies in the range 10 kHz to 20 kHz are typically within the audible range of humans. Ultrasonic vibration often produces cavitation, or the formation of small gas bubbles, in a sub-cooled solution. In the transient or inertial cavitation regime, the gas bubbles rapidly grow and collapse, causing very high localized pressure and temperature fluctuations. The ability of ultrasonic vibration to induce nucleation in a metastable material is often attributed to the disturbances caused by transient cavitation. The other cavitation regime, termed stable or non-inertial, is characterized by bubbles that exhibit stable volume or shape oscillations without collapse. U.S. Patent Application 20020031577 A1 discloses that ultrasonic vibration can induce nucleation even in the stable cavitation regime, but no explanation of the phenomenon is offered. GB Patent Application 2400901A also discloses that the likelihood of causing cavitation, and hence nucleation, in a solution using vibrations with frequencies above 10 kHz may be increased by reducing the ambient pressure around the solution or dissolving a volatile fluid in the solution. For large scale industrial freeze-dryers, implementation of the "ultrasonic" method poses significant system design challenges to achieve uniform distribution of the "ultrasound" energy throughout the freeze-dryer, and to maintain cleaning standards required for a cGMP sterile fill and finish manufacturing operation.

An electro-freezing method has also been used in the past to induce nucleation in sub-cooled liquids. Electro-freezing is generally accomplished by delivering relatively high electric fields (~0.01 V/nm) in a continuous or pulsed manner between narrowly spaced electrodes immersed in a sub-cooled liquid or solution. Drawbacks associated with an electro-freezing process in typical lyophilization applications include the relative complexity and cost to implement and maintain, particularly for lyophilization applications using multiple vials or containers. Also, electro-freezing cannot be directly applied to solutions containing ionic species (e.g., NaCl).

Recently, there are studies that examine the concept of 'vacuum-induced surface freezing' (See e.g., U.S. Pat. No. 6,684,524). In such 'vacuum induced surface freezing,' vials containing an aqueous solution are loaded on a temperature controlled shelf in a freeze-dryer and held initially at about 10 degrees Celsius. The freeze-drying chamber is then evacuated to near vacuum pressure (e.g., 1 mbar) which causes surface freezing of the aqueous solutions to depths of a few millimeters. Subsequent release of vacuum and decrease of shelf temperature below the solution freezing point allows growth of ice crystals from the pre-frozen surface layer through the remainder of the solution. A major drawback for implementing this 'vacuum induced surface freezing' process in a typical lyophilization application is the high risk of violently boiling or out-gassing the solution under stated conditions.

Therefore, a need exists for a freeze-dryer adapted for directly controlling the nucleation of freezing in the material undergoing lyophilization. Improved control of the nucleation process can enable the freezing of all unfrozen pharmaceutical solution vials in a freeze-dryer to occur within a more narrow temperature and time range, thereby yielding a lyophilized product with greater uniformity from vial-to-vial. Controlling the lowest nucleation temperature affects the ice crystal structure formed within the vial and allows for a greatly accelerated freeze-drying process.

SUMMARY OF THE INVENTION

The present invention may be characterized as a freeze-dryer system comprising: a freeze-drying chamber defining a freeze-drying chamber volume and further defining one or more depressurization orifices; a gas pressurization circuit having a source of gas coupled to the freeze-dryer to pressurize the freeze-drying chamber to a prescribed pressure; a depressurization circuit coupled to the freeze-drying chamber via the one or more depressurization orifices, the depressurization circuit further including a depressurizing control valve that together with the depressurization orifices defines a total depressurization orifice area; and one or more control means adapted to pressurize the freeze-drying chamber with the source of gas and actuate the depressurizing control valve to rapidly depressurize the freeze-drying chamber. Other typical components of the freeze-dryer system may include the refrigeration system, vacuum system, condenser chamber, etc. Embodiments of the disclosed freeze-dryer system have a ratio of total depressurization orifice area to the freeze-drying chamber volume that is between about $1\times10^{-1}$ $m^2/m^3$ and $1\times10^{-4}$ $m^2/m^3$ and more preferably between about $6\times10^{-2}$ $m^2/m^3$ and about $4\times10^{-4}$ $m^2/m^3$. Also, the one or more control means include either manual or automated means adapted to actuate the depressurizing control valve to depressurize the freeze-drying chamber when the product, the product container, the shelf surface, or the heat transfer fluid circulating in the hollow shelf (all four of which are in direct heat transfer communication with each other) attains a prescribed temperature or at a prescribed time after the product, the product container, the shelf surface, or the heat transfer fluid circulating in the hollow shelf attains the prescribed temperature.

The invention may also be characterized as a system and method for retrofitting freeze dryers. The present method of retrofitting a freeze-dryer comprising the steps of: (a) providing one or more depressurization orifices in fluid communication with a freeze-drying chamber of the freeze dryer; (b) coupling a gas pressurization circuit to the freeze-drying chamber, said gas pressurization circuit adapted to deliver a gas to pressurize the freeze-drying chamber to a prescribed pressure; and (c) coupling one or more depressurization control valves to the one or more depressurization orifices, the one or more depressurization orifices and one or more depressurization control valves defining a total depressurization orifice area; wherein the ratio of total depressurization orifice area to the freeze-drying chamber volume is between about $1\times10^{-1}$ and about $1\times10^{-4}$ $m^2/m^3$.

BRIEF DESCRIPTION OF THE DRAWINGS

The above and other aspects, features, and advantages of the present invention will be more apparent from the following, more detailed description thereof, presented in conjunction with the following drawings, wherein.

DETAILED DESCRIPTION

Nucleation is the onset of a phase transition in a small region of a material. For example, the phase transition can be the formation of a crystal from a liquid. The crystallization process (i.e., formation of solid crystals from a solution) often associated with freezing of a solution starts with a nucleation event followed by crystal growth.

In the crystallization process, nucleation is the step where selected molecules dispersed in the solution or other material start to gather to create clusters on the nanometer scale as to become stable under the current operating conditions. These stable clusters constitute the nuclei. The clusters need to reach a critical size in order to become stable nuclei. Such critical size is usually dictated by the operating conditions such as temperature, contaminants, degree of super-saturation, etc. and can vary from one sample of the solution to another. It is during the nucleation event that the atoms in the solution arrange in a defined and periodic manner that defines the crystal structure.

Crystal growth is the subsequent growth of the nuclei that succeed in achieving the critical cluster size. Depending upon the conditions either nucleation or crystal growth may predominate over the other, and as a result, crystals with different sizes and shapes are obtained. Control of crystal size and shape constitutes one of the main challenges in industrial manufacturing, such as for pharmaceuticals.

The present freeze-dryer and associated method of controlling the same enables precise control of the nucleation of freezing in the material contained in vials on the freeze-dryer shelves. In most freeze-drying applications, the probability that the material will spontaneously nucleate and begin changing phase has typically been solely related to the degree of sub-cooling of the material and the absence or presence of contaminants, additives, structures, or ultrasonic disturbances that provide a site or surface for nucleation.

The freezing or solidification step is particularly important in the freeze-drying process where existing techniques result in nucleation temperature differences across a multitude of vials, containers or production batches. The nucleation temperature differences tend to produce a non-uniform product and an excessively long drying time. The present freeze-dryer system and associated control methods, on the other hand, provide a higher degree of process control in batch solidification processes (e.g., freeze-drying) and produce a product with more uniform structure and properties.

Figure 1:
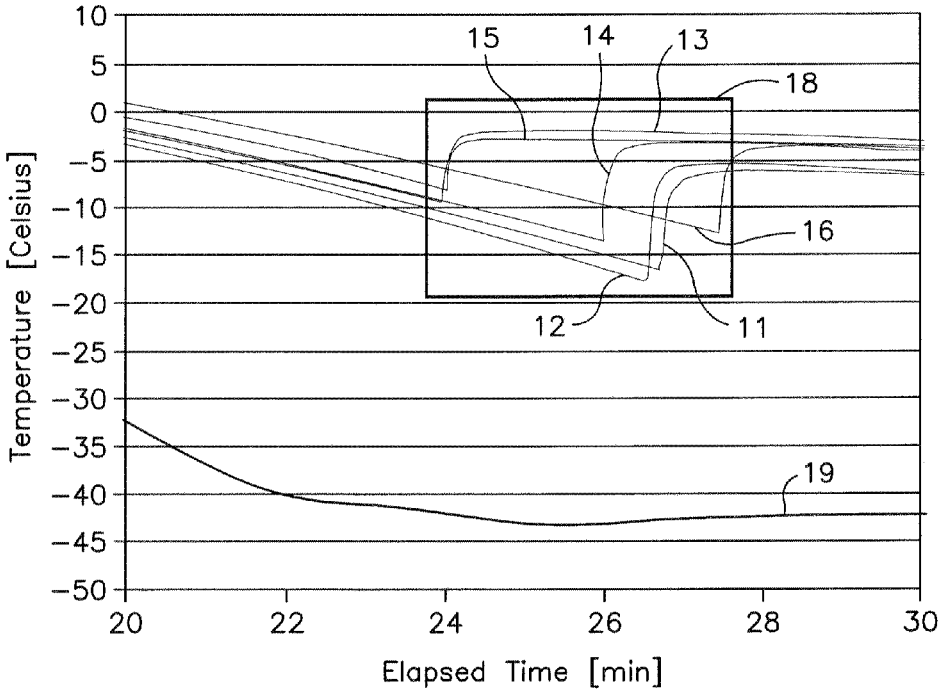
FIG. 1 is a graph depicting the temperature versus time plot of a solution undergoing a stochastic nucleation process and further showing the range of nucleation temperatures of the solution.

Turning now to the drawings, and in particular FIG. 1, there is depicted a temperature versus time plot of six vials of an aqueous solution undergoing a conventional stochastic nucleation process showing the typical range of nucleation temperatures of the solution within the vials (11, 12, 13, 14, 15, and 16). As seen therein, the vial contents have a thermodynamic freezing temperature of about 0° C. yet the solution within each vial randomly nucleates over the broad temperature range of about −7° C. to −20° C. or lower, as highlighted by area 18. Plot 19 represents the shelf temperature inside the freeze-drying chamber.

Figure 2:
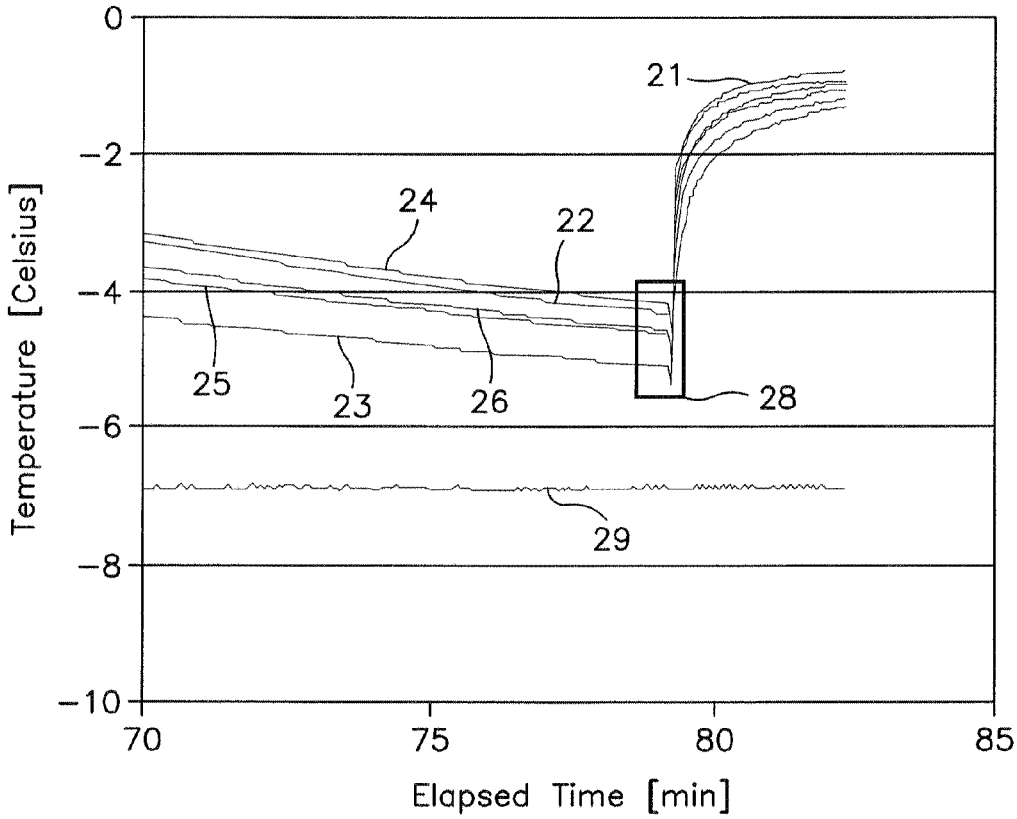
FIG. 2 is a graph depicting the temperature versus time plot of a solution undergoing equilibrated cooling with the controlled or depressurized nucleation process.
Figure 3:
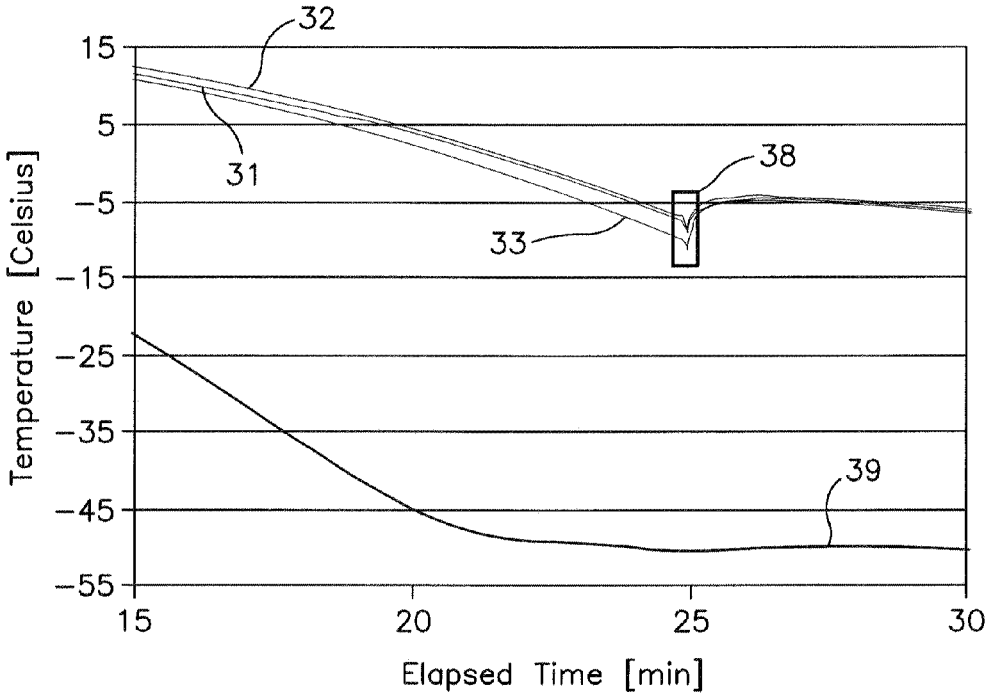
FIG. 3 is a graph depicting the temperature versus time plot of a solution undergoing dynamic cooling with the controlled or depressurized nucleation process.

Conversely, FIG. 2 and FIG. 3 depict temperature versus time plots of a solution undergoing a freezing process with depressurized nucleation in accordance with the present methods. In particular, FIG. 2 shows the temperature versus time plot of six vials of an aqueous solution undergoing an equilibrated cooling process with nucleation induced via depressurization of the chamber (21, 22, 23, 24, 25, and 26). The vial contents have a thermodynamic freezing temperature of about 0° C. yet the solution within each vial nucleates at the same time upon depressurization and within a very narrow temperature range (i.e., −4.2° C. to −5.1° C.) as seen in area 28. Plot 29 represents the shelf temperature inside the freeze-drying chamber and depicts an equilibrated freezing process, one where the temperature of the shelves is held more or less steady for a prescribed time prior to depressurization.

Similarly, FIG. 3 shows the temperature versus time plot of three vials of an aqueous solution undergoing a dynamic cooling process (31,32,33) with nucleation induced via depressurization of the chamber. Again, the vial contents have a thermodynamic freezing temperature of about 0° C. yet the solution within each vial nucleates at the same time upon depressurization at a temperature range of about −6.8° C. to −9.9° C. as seen in area 38. Plot 39 represents the shelf temperature inside the freeze-drying chamber and generally depicts a dynamic cooling process, one where the temperature of the shelves is actively lowered during or a short time prior to depressurization.

The present system provides improved control of the nucleation process by enabling the simultaneous freezing of pharmaceutical solutions in a freeze-dryer to occur within a more narrow temperature range (e.g., about 0° C. to −10° C.) using sudden depressurization thereby yielding a frozen solution with larger ice crystal formations which after drying yields improved lyophilized product with greater uniformity from vial-to-vial.

By controlling the minimum or lowest nucleation temperature and/or the precise time of nucleation one can influence or affect the ice crystal structure formed within the frozen vials or containers. The ice crystal structure is a variable that directly affects the time it takes for the ice to sublimate during the subsequent drying process and ultimately the moisture content and potentially the structure and performance characteristics of the final lyophilized product. Thus, by controlling the ice crystal structure formed during nucleation, it is possible to greatly accelerate the overall freeze-drying process, improve the final product, and improve the vial-to vial product uniformity.

It is generally recognized that smaller ice crystals resulting from deep sub-cooling in stochastically nucleated processes reduce the primary drying rate as mass transfer is restricted or limited through the small pores left behind by the sublimating ice crystals. As a result, the primary drying step must be run excessively long to accommodate the slowest drying vials, i.e., those vials that stochastically nucleated at the coldest temperatures. The longer primary drying process results in increased costs and reduces the overall lyophilizing capacity.

While the freeze-drying process is considered a relatively gentle preservation method, the inherent freezing stresses still have an adverse impact on product yield, particularly for sensitive biologics. Ice formation often damages the active pharmaceutical ingredient (API) directly through physical or interfacial interactions or indirectly through severe changes in the osmotic forces or solute concentrations experienced by the API. Since the nucleation process impacts the kinetics and structure of ice formation in the lyophilized product, it can significantly influence these stresses. For example, deeper sub-cooling prior to nucleation results in smaller ice crystals, which possess greater surface area on which proteins may denature and aggregate.

Figure 4A:
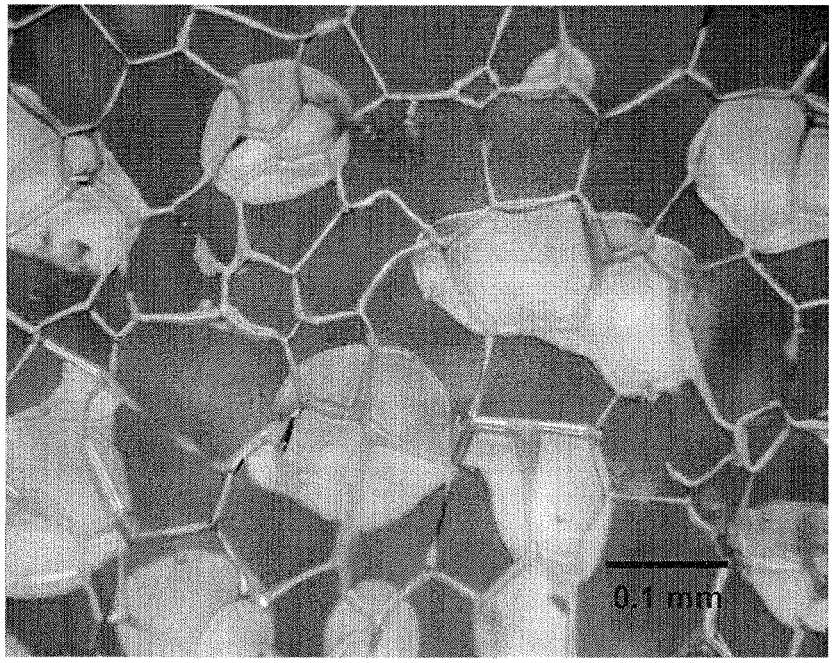
FIG. 4A and FIG. 4B are light microscopy images of the dried product after freezing using a stochastic nucleation process and the controlled or depressurized nucleation process, respectively.
Figure 4B:
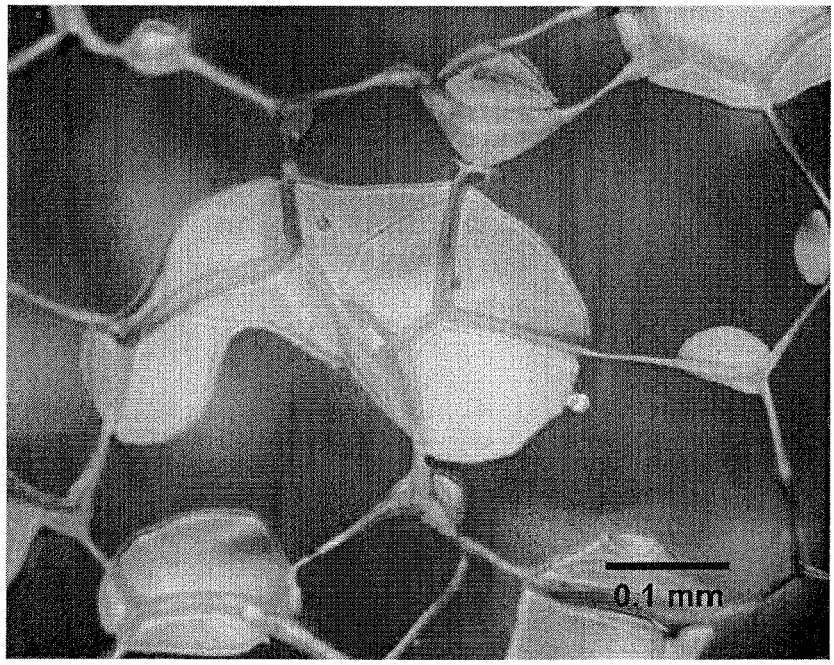

Turning now to FIGS. 4A and 4B there is shown comparative light microscopy images of the dried product after freezing using a stochastic nucleation process (FIG. 4A) and the dried product after freezing using the presently disclosed controlled nucleation process (FIG. 4B). Images were obtained with polarized light microscopy at 200× magnification, surface areas were measured by nitrogen adsorption using the BET method, and pore volumes were measured by mercury intrusion. As shown in FIGS. 4A and 4B, the size of the pores in the dried product resulting from the present controlled nucleation process are substantially larger in size than the pores in the dried product formed in a stochastic nucleation process. In particular, controlled nucleation via the present controlled nucleation method at warmer nucleation temperatures produces substantially larger pores in the microstructure of the dried product or cakes compared to the pores in the microstructure of the cakes freeze-dried using the traditional stochastic nucleation process.

In addition, the present controlled nucleation process also has been shown to reduce the absolute standard deviation in percent residual moisture for samples of mannitol cakes from about 4.6% when stochastically nucleated to about 2.1% when nucleated using the present controlled nucleation process. This reduction in absolute standard deviation further demonstrates the capability to achieve improved product uniformity via the present controlled nucleation process.

Figure 5:
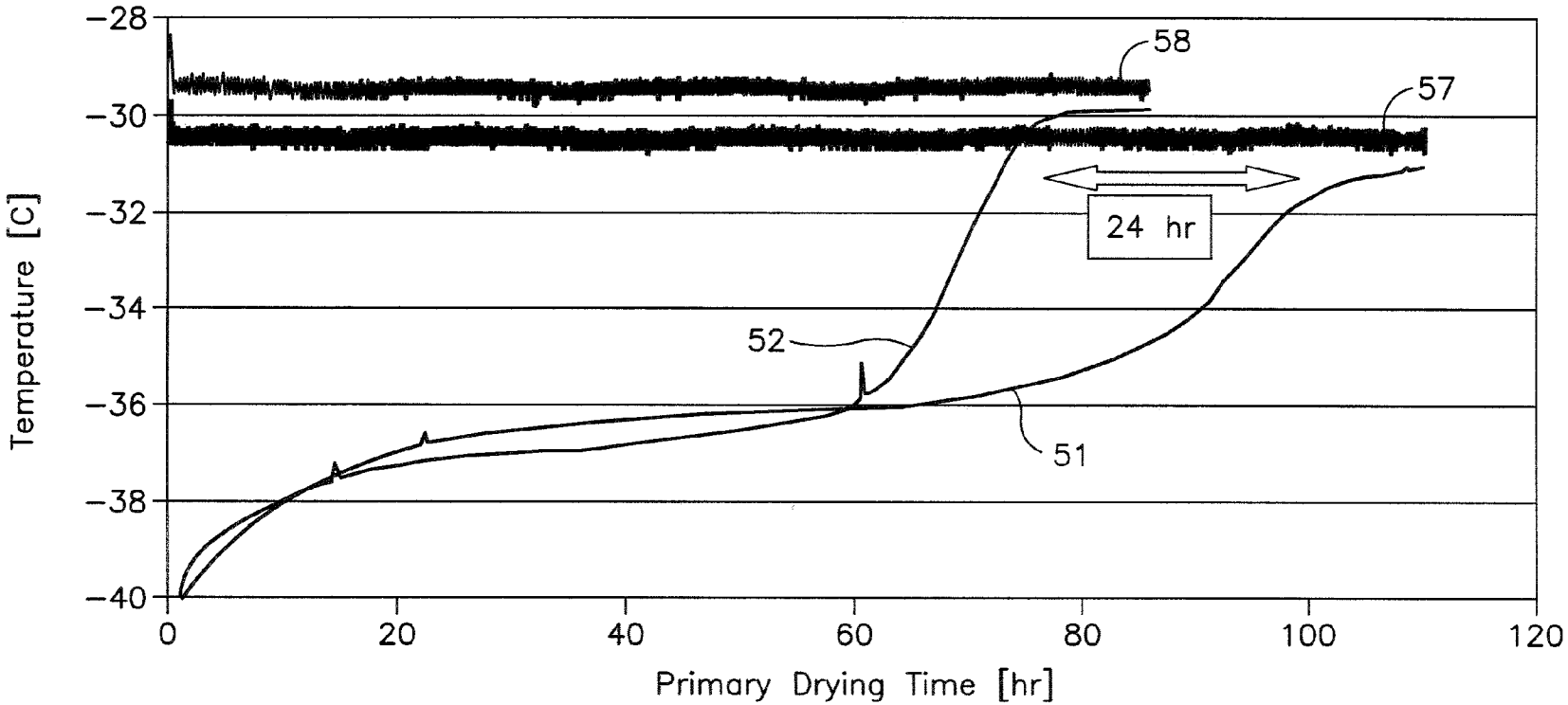
FIG. 5 is a graph that depicts the primary drying times of product samples nucleated using a stochastic nucleation process and the controlled or depressurized nucleation process.

FIG. 5 depicts the primary drying times in the form of temperature versus time graphs of identical samples nucleated using a stochastic nucleation process and the controlled nucleation process. As seen therein, the sample product that was frozen using the stochastic nucleation process, represented by curve 51, was dried in a freeze-drying chamber having a shelf temperature slightly colder than about −30° C. (see curve 57). The resulting primary drying time was in excess of about 118 hours for the sample to attain the desired final state. In comparison, the same sample product was frozen using the controlled nucleation process, represented by curve 52, was dried in a freeze-drying chamber having a shelf temperature of slightly warmer than about −30° C. (see curve 58) and wherein the resulting primary drying time was only about 86 hours. This represents a reduction or improvement in primary drying time of more than 20% compared to the sample product nucleated stochastically. The shelf temperature was set slightly warmer for the controlled nucleation case as compared to the uncontrolled nucleation case to try to achieve similar product temperatures and thereby focus the study on the impact of cake structure on drying time with the impact of product temperature minimized as much as possible. The controlled nucleation process enables faster primary drying, and with all other process conditions held generally constant, faster primary drying reduces product temperature due to the endothermic nature of sublimation. It should be noted that the product temperature for the controlled nucleation case even after this shelf temperature adjustment was still colder than in the case of uncontrolled nucleation. Thus, further upward shelf temperature adjustments could have been chosen to reach identical product temperatures and additional improvements in primary drying time could have been attained for equivalent product temperatures. Without being bound by any particular theory, the improved drying time is believed to be a direct result of the ice crystal structure formed during the nucleation of the sample products.

Figure 6:
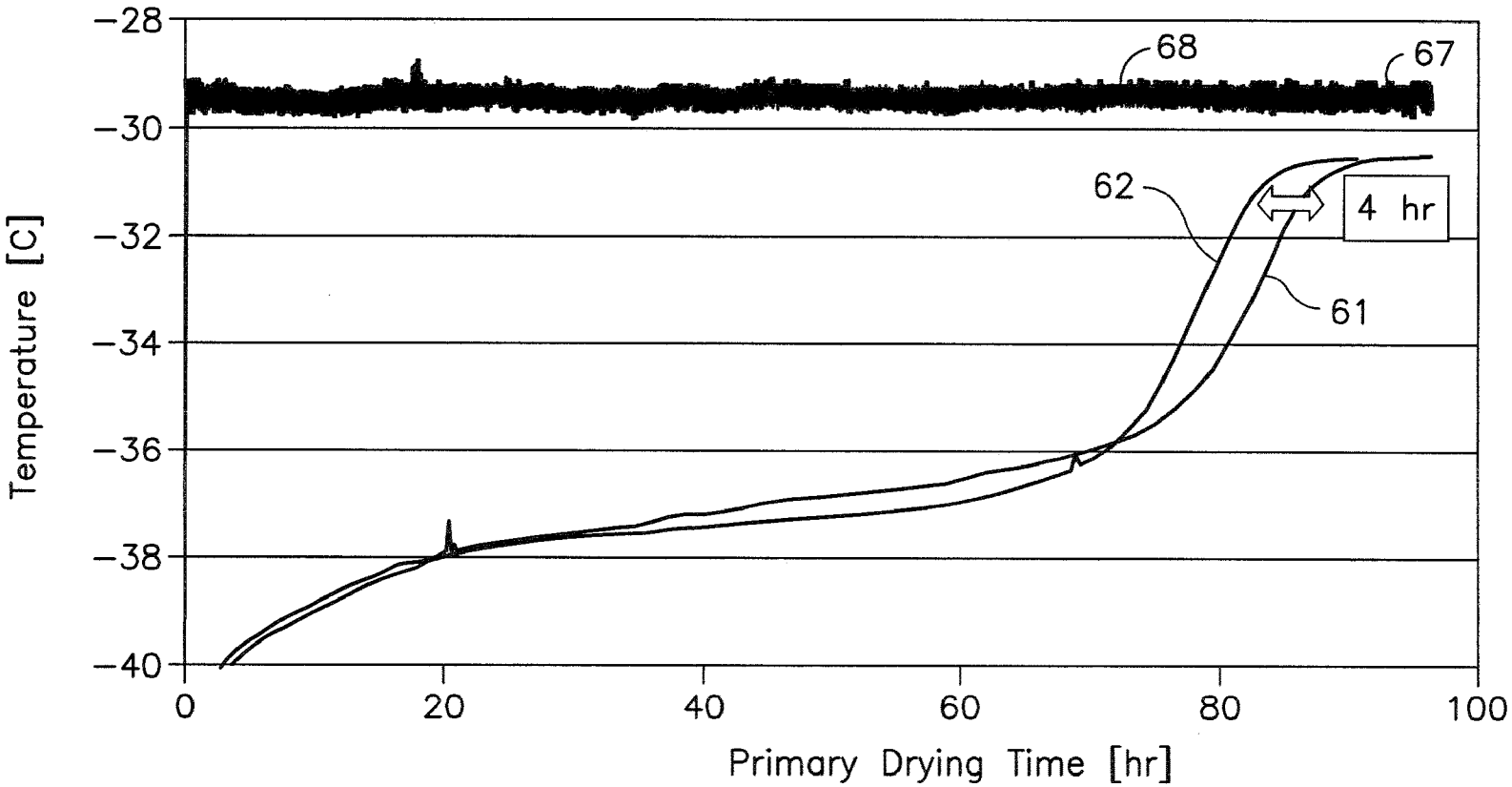
FIG. 6 is a graph that also depicts the primary drying times of product samples nucleated using the controlled or depressurized nucleation process but at different nucleation temperatures.

FIG. 6 depicts the benefit of reduced primary drying times in the form of temperature versus time graphs of identical samples nucleated using the controlled nucleation process with a nucleation temperature of about −8° C. and the controlled nucleation process with a nucleation temperature of about −3° C. As seen therein, the sample product that was frozen using the controlled nucleation process with a nucleation temperature of about −8° C, represented by curve 61, was dried in a freeze-drying chamber having a shelf temperature slightly warmer than −30° C. (see curves 67, 68). The resulting primary drying time was about 4 hours longer than the same sample product frozen using the controlled nucleation process with a nucleation temperature of about −3° C., represented by curve 62. This data suggests that the temperature at which nucleation is induced during the present controlled nucleation process has an effect on ice crystal formation, with warmer nucleation temperatures resulting in larger ice crystal structures. Since the controlled nucleation process allows precise control of the nucleation temperature of the product within the freeze-drying chamber, such a system and method allows for more control of the intermediate products in the freeze-drying process as well as the improved control of the freeze-drying process and characteristics of the final lyophilized product. It is also important to note that the final ice crystal structure and the final dried product may be impacted by not only the depressurization method and nucleation temperature, but also by the cool-down rate and freezing profile post-nucleation.

Other potential benefits of the present controlled nucleation process may include reduced protein aggregation and improved product activity. These effects have been explored using the model protein lactate dehydrogenase (LDH) with dynamic light scattering (DLS), size exclusion chromatography (SEC), and enzyme activity assays. LDH sourced from two different vendors were combined at a concentration of 1, 0.25, or 0.05 mg/mL with either 12.5 or 100 mM citrate (pH 7.5) or tris(hydroxymethyl)methylamine (Tris) (pH 7.5) buffer to make twenty-four different test formulations. These twenty-four different test formulations were subjected to a single freeze-thaw cycle in a freeze-dryer with ramp rates of approximately 1° C./min using stochastic nucleation and controlled nucleation. DLS and SEC test results confirmed that LDH experienced severe aggregation in 16 of 24 cases (67%) when nucleation was stochastic and only 6 of 24 cases (25%) when nucleation was controlled. Activity assays for 1 mg/mL LDH in 5 wt % mannitol after freeze-thaw in a freeze-dryer indicated a 34% loss of activity for stochastic nucleation compared to only a 20% loss of activity for controlled nucleation. Thus, it is possible to substantially mitigate freezing stresses on proteins using controlled nucleation to optimize the kinetics and structure of ice crystallization.

Figure 7:
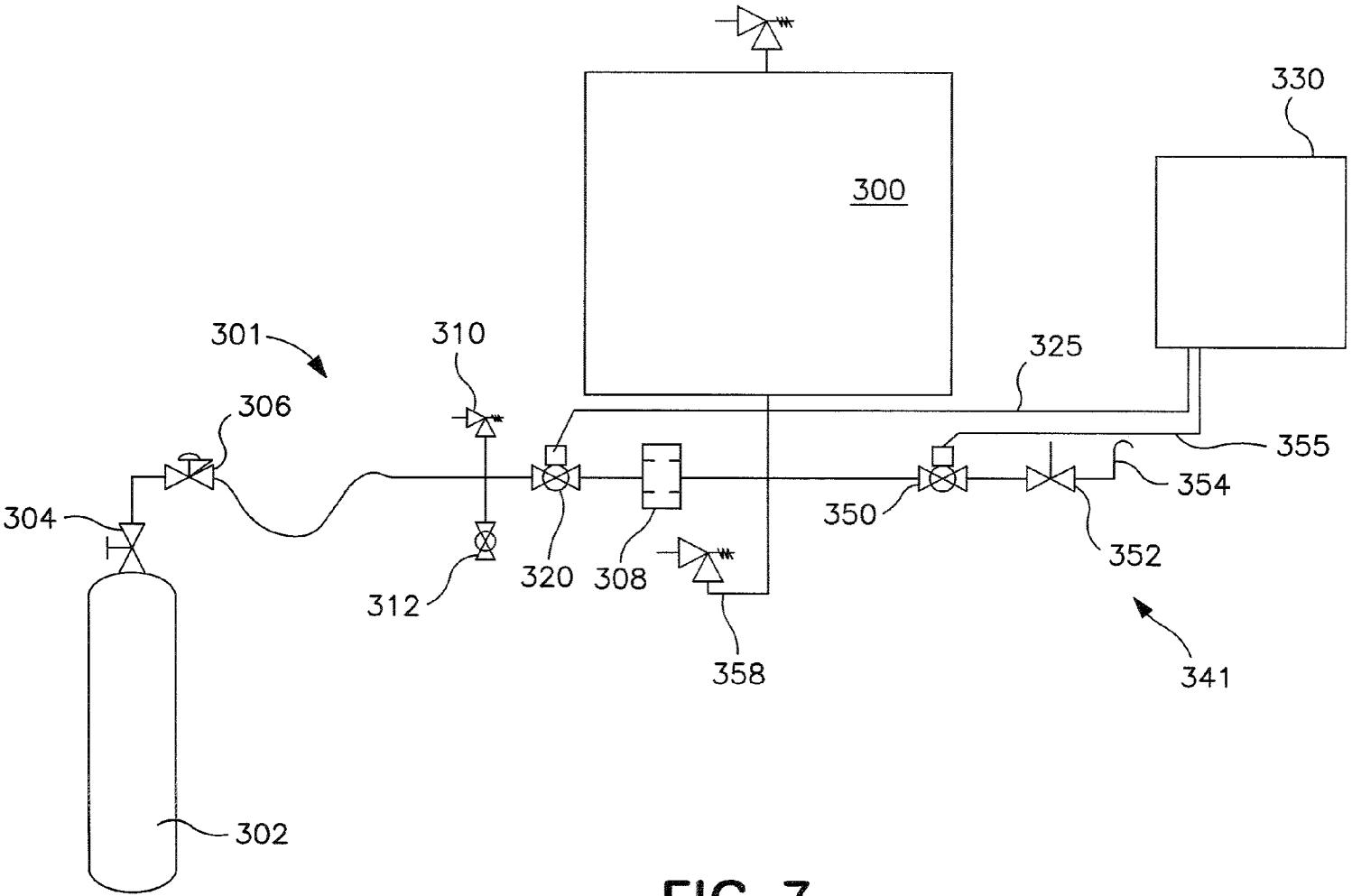
FIG. 7 is a schematic representation of a freeze-dryer system incorporating and adapted to utilize the controlled or depressurized nucleation process.

Turning now to FIG. 7, there is shown a schematic embodiment of the freeze-dryer with an associated pressurization and depressurization system. As seen therein, the freeze-dryer defines a freeze-drying chamber 300 containing the materials to be lyophilized or freeze-dried. The freeze-dryer further includes one or more orifices through which the freeze-drying chamber 300 is pressurized and depressurized. Pressurization of the freeze-drying chamber 300 is preferably accomplished with a pressurization circuit 301 that includes a source of gas 302, a gas source valve 304 and regulator 306, a relief valve 310, line vent 312, all disposed upstream of the chamber pressurization control valve 320 and a sterilizing filter, such as a 0.01 micron filter, 308 disposed downstream of the chamber pressurization control valve 320. The chamber pressurization control valve 320 is controllably actuated in response to command signals 325 from the system controller 330. The number and size of the valves, filters, and associated instrumentation in the pressurization circuit 301 should be appropriately chosen so as to avoid excessively long pressurization times. The operating pressures should remain at subcritical pressures of the applied gas (i.e. subcritical pressure conditions) and also below the design pressure rating of the original or modified equipment.

The temperatures of the pressurizing gas and the gas in the chamber before depressurization may be colder, nearly the same, or warmer than the temperature of the contents of the containers. In some applications, use of a cold pressurizing gas may be advantageous in that it provides additional means to rapidly equilibrate the temperature of the material prior to inducing the nucleation of freezing.

The illustrated system also comprises a depressurization circuit 341 that includes a chamber depressurization control valve 350, controllably actuated in response to command signals 355 from the system controller 330, and a throttle valve 352. Upon receipt of a depressurization command, the depressurization control valve 350 opens and the freeze-drying chamber 300 rapidly depressurizes allowing the gas to flow through the depressurization circuit 341 to the exit vent 354. In the illustrated embodiment, the throttle valve 352 is used to restrict the flow in the depressurization circuit 341 so as to provide an effective adjustment in cross-sectional area of the depressurization orifices. The illustrated system further includes temperature and pressure sensors (not shown) as well as one or more relief valves 358 associated with the pressurization circuit 301, depressurization circuit 341 and freeze-drying chamber 300 so as to avoid over-pressurization conditions. Although the illustrated embodiment depicts a single depressurization circuit, it is fully contemplated that a plurality of depressurization circuits can also be used.

The sizing and configuration of the depressurization circuit(s) 341 in relation to the size of the freeze-drying chamber 300 is an important, if not critical design parameter. The effective cross-sectional area used for depressurization is critical to the success of the depressurization method as it controls the time it takes to depressurize as well as the depressurization profile and related dynamic conditions established in the freeze-drying chamber. For purposes of clarity, the orifice area for each depressurization circuit is defined as the minimum cross-sectional area in the respective depressurization circuit, which provides the controlling restriction and determines the depressurization time and kinetics. The total depressurization orifice area is defined as the sum of the orifice areas for each depressurization circuit. It should also be noted that the same orifice or orifices can be used for pressurization and depressurization of the freeze-drying chamber 300 as well as any chamber purging or sanitation processes involved in the freeze-drying process.

Figure 8:
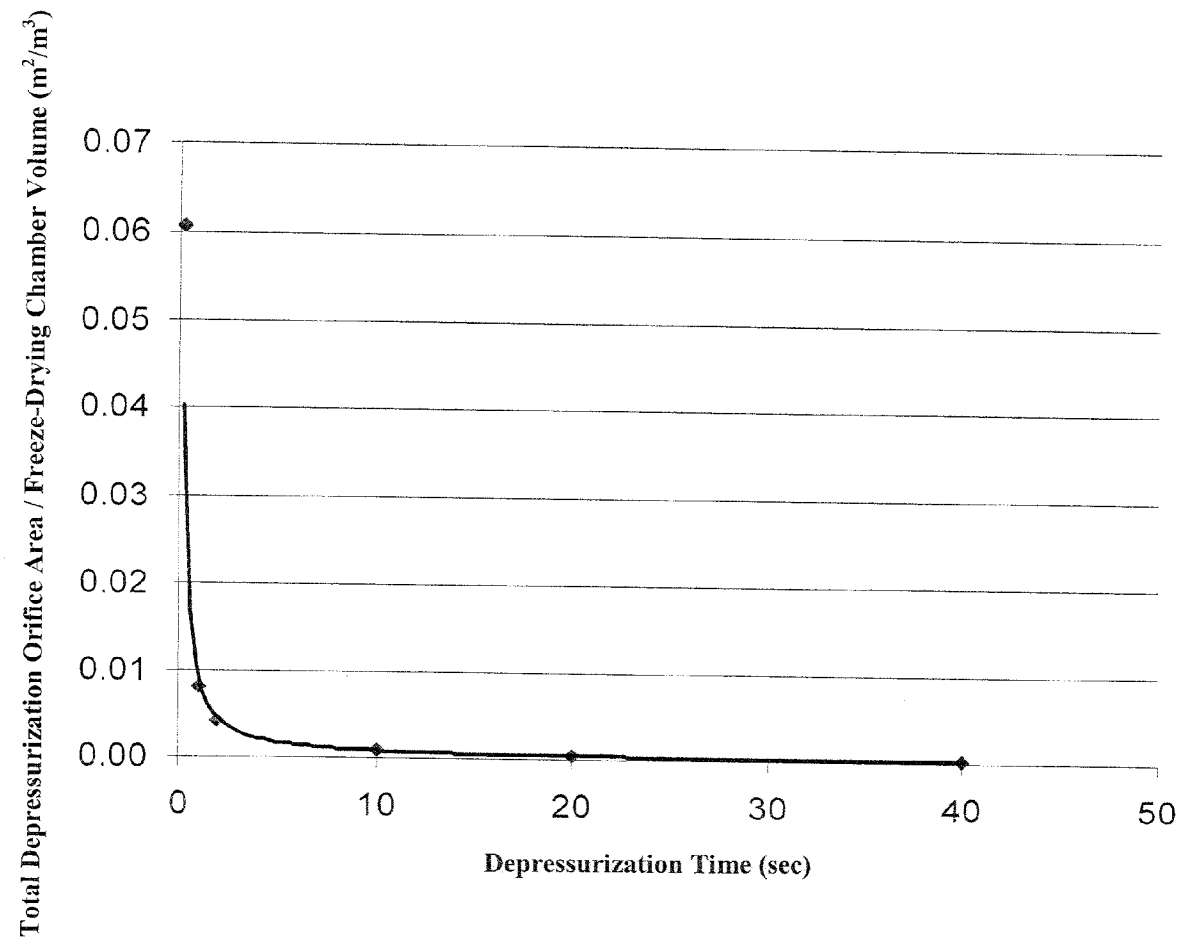
FIG. 8 is a graph that depicts the ratio of total depressurization orifice area to freeze-drying chamber volume versus depressurization time for an embodiment of the present invention.

FIG. 8 depicts a graph showing the preferred total depressurization orifice area to freeze-drying chamber volume ratios versus depressurization time that was developed as part of a computer simulation and for freeze-drying chamber volumes in the range of about 1 $m^3$ to about 100 $m^3$. The simulation was verified by depressurization time measurements on actual freeze-dryers. The illustrated graph assumes argon is used as the pressurizing gas in the chamber while the overall pressure drop was from about 15 psig to near atmospheric pressure at standard lyophilization temperatures. Similar curves exist for other pressurization gases, overall pressure drops, and temperatures. It has been found that the desired total depressurization orifice area to freeze-drying chamber volume ratios for effective nucleation control are very much dependant on temperature, pressure drop and gas composition. As seen in FIG. 8, the preferred total depressurization orifice area to freeze-drying chamber volume ratio is between about $6\times10^{-2}$ and about $4\times10^{-4}$ $m^2/m^3$.

The preferred range of total depressurization orifice area to freeze-drying chamber volume ratios is used to ascertain the preferred total orifice diameters when retrofitting or designing freeze-driers. For example, a freeze-dryer having a freeze-drying chamber volume of about 5 $m^3$ would typically need standard depressurization valves/orifices ranging from about 2 inches to about 24 inches in total diameter. Similarly, a freeze-dryer having a freeze-drying chamber volume of about 100 $m^3$ would typically need standard depressurization valves/orifices ranging from about 8 inches to about 32 inches or more in total diameter to achieve the rapid depressurization employed in the present controlled nucleation process.

As is known in the art, commercial freeze-dryer systems may include either an internal or external condenser. In the case of external condensers, the product chamber holding the materials to be freeze-dried is typically connected to a condensing chamber by means of a conduit with a chamber isolation valve. In general, the orifices presented by the chamber isolation valve and conduit diameter are sufficient to achieve the depressurization rates necessary to controllably induce nucleation. Therefore, one way to achieve depressurization in a freeze-dryer with an external condenser is to open the chamber valve that separates the drying chamber from the condensing chamber. Ideally, the condensing chamber should be maintained at an appropriate initial pressure to provide a sufficient magnitude of depressurization as described above.

In the case of a freeze-dryer with an internal condenser, this method requires one or more appropriately sized depressurization orifices to be provided or placed in communication with the freeze-drying chamber and separated from the ambient environment or a controlled pressure environment by one or more depressurization control valves. In the case of a freeze-dryer with an external condenser, the depressurization orifices can be disposed proximate the freeze-drying chamber, the condensing chamber, or the conduit connecting the two chambers. If the orifices are on the condensing chamber or in the conduit between the isolation valve and the condensing chamber, then the isolation valve separating the freeze-drying chamber and the condensing chamber must also be opened to achieve depressurization. In some embodiments, more than one freeze-drying chamber may be connected to a single condensing chamber and vice versa.

Although not shown, the freeze-dryer system also typically includes various control hardware and software systems adapted to command and coordinate the various parts of the freeze-drying equipment, and carry out the pre-programmed freeze-drying cycle. The various control hardware and software systems may also provide documentation, data logging, alarms, and system security capabilities as well. In addition, auxiliary systems to the freeze-dryer system may include various subsystems to clean and sterilize the product chamber, auto-load and unload the product in the product chamber, and associated mechanical or cryogenic refrigeration system accessories such as refrigeration skids, compressors, condensers, heat exchangers, heat transfer fluid systems, pumps, heaters, expansion tanks, cryogen tanks, piping, valves, sensors, etc.

The detailed examples set forth in U.S. patent application Ser. No. 11/702,472 filed Feb. 5, 2007, the entire disclosure of which is incorporated herein by reference, highlight various aspects and features of the presently disclosed freeze-dryer control methods.

The preferred freeze-dryer system and method employing the controlled nucleation process involves many steps and, as described above may require prescribed equipment modifications. Generally, after the freeze-dryer has been sanitized or otherwise prepared, the material to be freeze-dried is loaded into the freeze-drying chamber in the appropriate vials or containers that are typically placed on freeze-drying shelves disposed within the freeze-drying chamber. Next, the freeze-drying chamber is closed and sealed sufficient to allow the freeze-drying chamber to be pressurized and depressurized. After the freeze-drying chamber is sealed, air within the chamber is preferably purged with a pressurization gas intended for subsequent pressurization in connection with the controlled nucleation method. The preferred pressurization gas is generally inert, such as argon or nitrogen, but other gases, including air, can also be effective. Such purge operation can be accomplished using a vacuum purge process or a pulse purge process. The vacuum purge process pulls the air out of the chamber using a vacuum pump and subsequently introduces the pressurization gas to the chamber to a pressure of about 1 psig. Alternatively, the pulse purge process pressurizes the chamber with the pressurization gas to about 15 psig and then depressurizes the chamber back to about 1 psig. The vacuum purge and pulse purge procedures may be repeated about three to five times to ensure the chamber atmosphere is substantially comprised of the pressurization gas.

After purging air from the freeze-drying chamber, the chamber is pressurized again with the pressurization gas from the gas source to a prescribed pressure set point. The gas source may be a compressed gas cylinder, gas storage container, pipeline gas source or even a generic gas generation device or small plant, such as an air separation unit or VPSA unit.

This pressurization is accomplished by first setting the cylinder pressure regulator 306 to between about 50 to 100 psig and inputting the prescribed pressure set point (preferably less than 50 psig) into the controller 330. The actual chamber pressurization occurs when the pressurization command from the controller 330 causes the pressurization control valve 320 to open and pressurize the chamber up to the prescribed pressure set point and then close the pressurization control valve 320 via appropriate command signals.

Before, during, or after the chamber has been pressurized, the freeze-dryer is cooled such that the material in the vials is cooled to the desired nucleation temperature. Specifically, the material in the vials is cooled by cooling the freeze-dryer shelves to a product nucleation temperature preferably between about −1° C. to about −10° C. Once cooled, the material in the vials may be allowed to equilibrate for about 15 minutes or so until the materials are at or near the desired nucleation temperature.

The next step is to nucleate the material in the vials by depressurizing the freeze-drying chamber. Depressurization can be achieved either via a pressure-based depressurization where the atmosphere in the chamber is evacuated until the chamber attains a depressurization set point that has been inputted into the controller 330 or via a time-based depressurization where the atmosphere in the chamber is evacuated for a prescribed depressurization duration, preferably about 0.5 to about 20 seconds, or more preferably to about 10 seconds including any delay to account for depressurization control valve 350 reaction time. Longer depressurization times may also be employed provided such depressurization results in substantially uniform nucleation. In either approach, depressurization speed is also controllable by setting the vent throttle 352 to the desired position. Depressurization occurs when the controller 330 sends the appropriate command signals to the depressurization control valve 350.

After the nucleation step, the materials in the vials are further cooled to a final desired temperature, usually about −40° C. to about −45° C. When the materials reach a final desired temperature, sufficient time is allocated to complete the freezing prior to initiating any drying steps. During or after the freezing step, the condenser is cooled to a final condenser temperature of about −50 to −70° C. or whatever condenser surface temperature is adequate to ensure that the surface temperature of the ice accumulating on the condenser will maintain appropriate vacuum in the freeze-drying chamber.

After freezing is complete and the condenser is cold, the drying steps are initiated which include a primary drying step and secondary drying step. Primary drying involves activating the freeze-dryer vacuum pump and condenser refrigeration system to establish the desired sublimation and condensing conditions in the freeze-drying chamber. It may be advantageous to allow a small bleed flow of a gas (generally, an inert gas) into the chamber throughout the drying process to help control the vacuum level. After the vacuum pressure conditions are attained, the freeze-dryer shelves are warmed, usually at a controlled rate of about 0.5 to 1° C. per minute, to the desired primary drying temperature, which is dictated by the thermal and mechanical properties of the material undergoing freeze-drying. Primary drying is completed when all the ice has been removed by sublimation, as judged by product temperature measurements, humidity measurements, comparison of capacitance manometer and Pirani gauge measurements, analysis of samples obtained with a sample thief, or other techniques known in the art. Once primary drying is complete, the freeze-dryer shelf temperatures are further warmed at a desired warming rate, typically about 0.1 to 0.5° C. per minute, until the product or materials reach a temperature when desorption of bound water may be adequately achieved. This final product temperature depends on product composition and could be e.g. about 20° C. or higher. After drying is complete, the product or material is removed from the freeze-drying chamber. At any time during the process, the system is capable of emergency stop or shutdown which would close the pressurization and depressurization control valves and vent the chamber and any gas supply lines, as necessary.

Most commercial freeze-dryers can readily accommodate the range of operating pressures and pressure drops needed to control nucleation with the present controlled or depressurized nucleation process. In fact, many freeze-dryers are designed with pressure ratings in excess of 25 psig to withstand conventional sterilization procedures employing steam. Equipment modifications may be necessary for any freeze-dryer system that does not meet such standard equipment ratings in order to allow such pressurization and subsequent depressurization. Other changes to the lyophilization units may be necessary to allow repetitive and rapid pressurization and depressurization cycles.

Many conventional freeze-dryers already possess orifices suitable to accomplish the above-described depressurization method. These orifices may be connected to one of the following freeze-dryer system components including the gas line for controlling drying chamber pressure; gas line for backfilling containers in drying chamber with gas prior to stoppering; line connecting the external condenser to the freeze-drying chamber; vacuum line connecting the drying chamber or condensing chamber to the vacuum pump; drain lines to remove liquids (e.g., water) from the drying chamber or condensing chamber; vent lines to break pressure in the drying chamber or condensing chamber; lines on the drying chamber or condensing chamber connected to pressure relief devices; lines on the drying chamber or condensing chamber connected to clean-in-place or steam-in-place systems; validation ports; or viewing ports. If these existing orifices and their associated lines are appropriately sized to successfully accomplish the depressurization method, then they can be readily modified to include a separate branch and control valve to enable depressurization of the system to the ambient environment or a controlled pressure environment outside the freeze-dryer.

If necessary, the orifice or orifices on the freeze-drying chamber can be modified as needed (e.g., by adding a diffuser or silencer) to control the flow characteristics of gases leaving the chamber during depressurization. When pre-existing orifices either do not exist or are not appropriately sized or will otherwise not suffice for accomplishing the depressurization as described herein, one or more appropriately sized orifices should be added to the drying chamber and/or the condensing chamber.

From the foregoing, it should be appreciated that the present invention provides a freeze-dryer system and associated method of control. Although the invention has been described in detail with reference to certain preferred embodiments of a freeze-dryer system, as will occur to those skilled in the art, numerous other modifications, changes, variations, additions and omissions can be made without departing from the spirit and scope of the instant claims.

What is claimed is:

1. A freeze-dryer system comprising:

a freeze-drying chamber defining a freeze-drying chamber volume;

one or more depressurization orifices in fluid communication with the freeze-drying chamber;

a gas pressurization circuit having a source of gas coupled to the freeze-dryer to pressurize the freeze-drying chamber to a prescribed pressure;

a depressurization circuit coupled to the freeze-drying chamber via the one or more depressurization orifices, the depressurization circuit further including one or more depressurization control valves that together with the one or more depressurization orifices defines a total depressurization orifice area; and a micro-processor based control unit adapted to pressurize the freeze-drying chamber with the source of gas upon receipt of a pressurization command input or actuate the depressurization control valve to rapidly depressurize the freeze-drying chamber upon receipt of a depressurization command input wherein the ratio of total depressurization orifice area to the freeze-drying chamber volume is between about $1\times10^{-1}$ and about $1\times10^{-4}$ $m^2/m^3$.

2. The freeze-dryer system of claim 1 wherein the depressurization circuit further comprises one or more valves operatively controlled to allow adjustments or variations to the total depressurization orifice area.

3. The freeze-dryer system of claim 1 wherein the depressurization circuit further comprises one or more valves operatively controlled to allow adjustments or variations to the total depressurization time.

4. The freeze-dryer system of claim 1 wherein the gas pressurization circuit further comprises:

a source of gas;

a gas regulator coupled to the source of gas to control the delivery pressure and flow rate of the gas;

a gas filter disposed downstream of the source of gas; and a pressurization control valve operatively associated with the micro-processor based control unit, the pressurization control valve interposed between the source of gas and the freeze-drying chamber;

wherein the pressurization control valve is maintained in a first position during pressurization of the freeze-drying chamber to the prescribed pressure using the gas and a second position during depressurization of the freeze-drying chamber.

5. The freeze-dryer system of claim 1 wherein the source of gas is an inert gas.

6. The freeze-dryer system of claim 1 wherein the ratio of total depressurization orifice area to the freeze-drying chamber volume is between about $6\times10^{-2}$ and about $4\times10^{-4}$ $m^2/m^3$.

7. The freeze-dryer system of claim 1 further comprising one or more temperature sensors disposed in the freeze-drying chamber and operatively connected to the control unit and wherein the depressurization command input is generated when the temperature sensors detect a prescribed temperature.

8. The freeze-dryer system of claim 7 wherein the depressurization command input is generated a prescribed time after the temperature sensors detect the prescribed temperature.

* * * * *